United States Patent [19]

Tack, Jr.

[11] 4,446,785

[45] May 8, 1984

[54] HYDRAULIC CLUTCHING AND BRAKING SYSTEM FOR STARTING AND STOPPING A POWER PRESS

[75] Inventor: Carl E. Tack, Jr., Oak Park, Ill.

[73] Assignee: Danly Machine Corporation, Chicago, Ill.

[21] Appl. No.: 305,839

[22] Filed: Sep. 28, 1981

[51] Int. Cl.[3] ..... B30B 15/10; B30B 15/12

[52] U.S. Cl. ..... 100/35; 100/282; 192/12 C; 192/18 A

[58] Field of Search ..... 192/12 C, 56 F, 18 A, 192/13 R, .032; 100/35, 282, 280

[56] References Cited

U.S. PATENT DOCUMENTS

| | | | |
|---|---|---|---|
| 2,436,968 | 3/1948 | Longfield | 192/18 A |
| 2,577,641 | 12/1951 | Wissman | 100/282 X |
| 2,838,150 | 6/1958 | Eason | 192/18 A |
| 3,580,371 | 5/1971 | Kron | 192/18 A |

FOREIGN PATENT DOCUMENTS

| | | | |
|---|---|---|---|
| 1491203 | 11/1977 | United Kingdom | 192/56 F |

*Primary Examiner*—Billy J. Wilhite
*Assistant Examiner*—Christine A. Peterson
*Attorney, Agent, or Firm*—Leydig, Voit, Osann, Mayer & Holt, Ltd.

[57] ABSTRACT

A clutch and brake system for starting and stopping a power press uses hydraulically actuated brake and clutch mechanisms. To start the press, the brake is hydraulically released while the clutch is hydraulically engaged at a predetermined intermediate torque level which is less than the full clutch torque level. The clutch is maintained at that intermediate torque level until the present drive shaft has attained its substantially full speed, and is then increased to the full clutch torque level. To stop the press, the clutch is hydraulically disengaged while the brake is hydraulically engaged at a predetermined intermediate torque level which is less than the full brake torque level. The brake is maintained at this intermediate torque level until the press drive shaft has substantially stopped, at which time the brake torque is increased to the full brake torque level.

22 Claims, 8 Drawing Figures

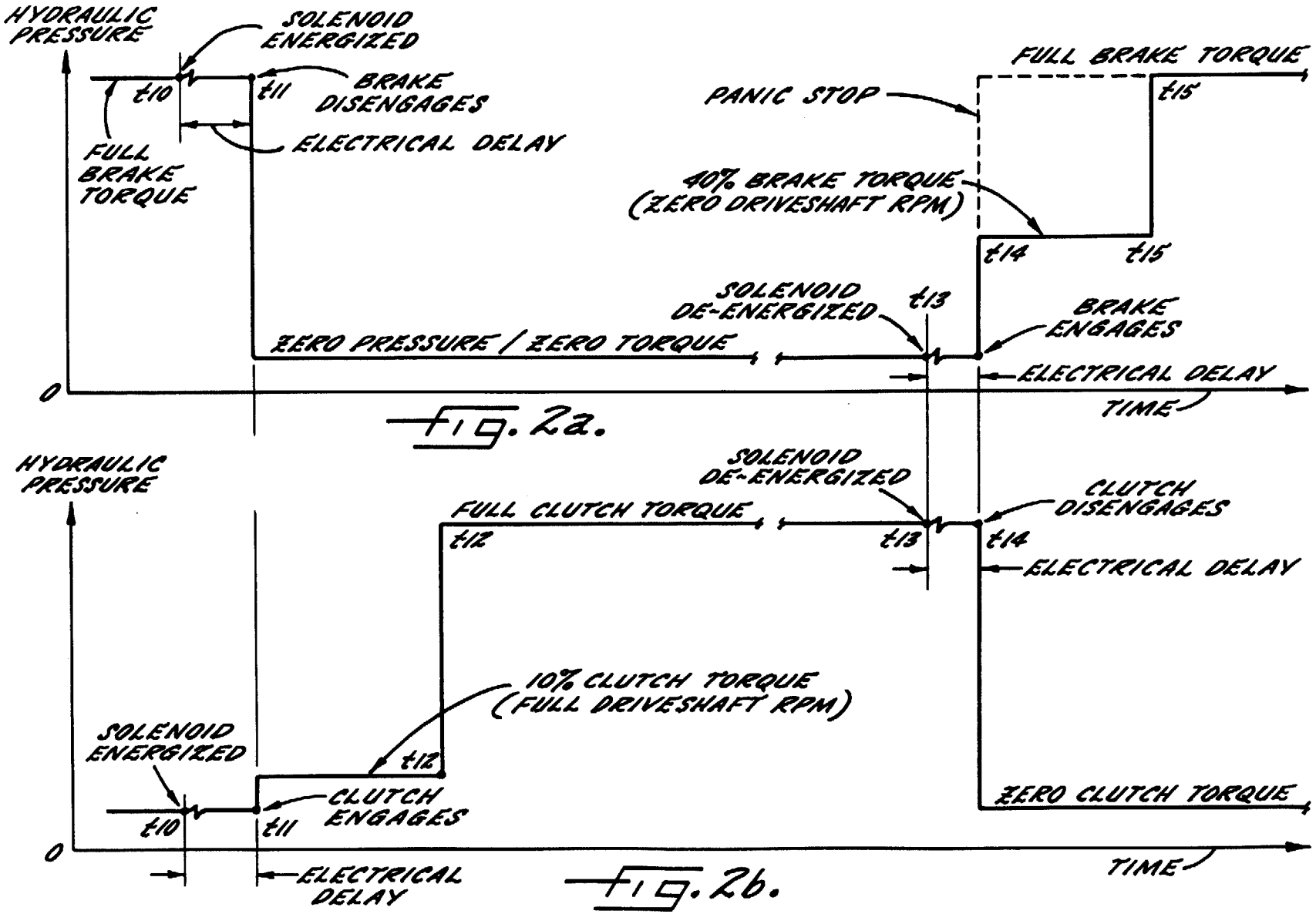
HYDRAULIC PRESSURE
SOLENOID ENERGIZED
BRAKE DISENGAGES
ELECTRICAL DELAY
FULL BRAKE TORQUE
t10
t11
0
ZERO PRESSURE / ZERO TORQUE
SOLENOID DE-ENERGIZED
t13
40% BRAKE TORQUE (ZERO DRIVESHAFT RPM)
PANIC STOP
t14
t15
BRAKE ENGAGES
ELECTRICAL DELAY
TIME
FULL BRAKE TORQUE
FIG. 2a.
HYDRAULIC PRESSURE
SOLENOID ENERGIZED
t10
t11
CLUTCH ENGAGES
ELECTRICAL DELAY
t12
10% CLUTCH TORQUE (FULL DRIVESHAFT RPM)
FULL CLUTCH TORQUE
SOLENOID DE-ENERGIZED
t13
t14
CLUTCH DISENGAGES
ELECTRICAL DELAY
ZERO CLUTCH TORQUE
TIME
FIG. 2b.

HYDRAULIC CLUTCHING AND BRAKING SYSTEM FOR STARTING AND STOPPING A POWER PRESS

DESCRIPTION OF THE INVENTION

The present invention relates generally to power presses and, more particularly, to an improved clutching and braking system for starting and stopping a power press.

Power presses are generally started and stopped by means of pneumatically operated clutch and brake mechanisms, although mechanical and eddy current clutches and brakes are also used to some extent. In the pneumatic systems, the press is started by pneumatically disengaging the brake and pneumatically actuating the clutch to engage the press drive, after which the pneumatic pressure continues to increase to build up the desired full clutch torque. As the clutch approaches the desired full torque level, the press drive is accelerated at an extremely rapid rate. To stop the press, the pneumatic pressure on both the brake and the clutch must be dissipated, after which the brake is applied by means of mechanical spring pressure. Dissipation of the pneumatic pressure sufficiently to engage the brake and disengage the clutch takes a long time, relative to the duration of one press cycle. In order to stop the press within a reasonable segment of a press cycle, therefore, the brake is normally applied with an extremely high force which stops the press rather abruptly after the clutch has been disengaged.

In an automated press, the abrupt transitions produced by the pneumatic system described above can disrupt the automation system and cause damage to the workpieces or the automation equipment. At the very least, the automation system must be programmed to provide excessive clearances between the various controlled mechanisms, which reduces the productivity of the press system.

One example of the type of abrupt transition that can lead to automation problems and/or reduced productivity is the rapid rate of acceleration produced by the pneumatically actuated clutch as it approaches its full torque level. A similar problem is presented by the high deceleration rate which follows engagement of the pneumatically actuated brake. These acceleration and deceleration rates can be as high as several "g"'s, while automated loaders for power presses often have a design limit of only about one "g".

In a mechanical automation system, these high rates of acceleration and deceleration can result in excessive forces on the cams and cam followers and even the mechanisms connected to the followers. For example, abrupt movements in such systems can cause the cam followers to become temporarily separated from their cams, after which the biasing forces exerted on the followers can cause the followers to slam back against the cams. This can damage the cams and/or the followers, and even when it does not result in any immediate damage, it can shorten the lives of the various parts involved via excessive wear rates and stresses.

In electrical automation systems, the high rates of acceleration and deceleration can cause the system to shut down because of velocity or acceleration limits built into such systems. Position errors are also likely to be introduced into such systems by the abrupt transitions of the pneumatic clutching and braking system.

It is, therefore, a primary object of the present invention to provide an improved system for starting and stopping a power press quickly and yet smoothly so as to avoid abrupt movements of the type that can disrupt the automation system. In this connection, a related object of the invention is to provide such a starting and stopping system which permits rapid response to signals commanding the press to start or stop, but which starts and stops the press in a "soft" manner without excessive rates of acceleration and deceleration.

Another important object of this invention is to provide such an improved starting and stopping system which permits increases in the productivity of an automated press system having automatically controlled workpiece handling mechanisms.

It is another object of this invention to provide such an improved system for starting and stopping a power press which minimizes the danger of damage to, and prolongs the operating life of, those portions of the press involved in, or controlled by, the automation system.

A further object of this invention is to provide an improved fast-acting but "soft" clutching and braking system for a power press.

Still another object of the invention is to provide an improved clutching and braking system which permits the brake to be applied at the same time that the clutch is being disengaged, thereby minimizing the stopping time and motion.

Other objects and advantages of the invention will be apparent from the following detailed description and accompanying drawings.

In accordance with the present invention, there is provided a system for starting and stopping a power press having a slide mechanism mounted for reciprocating movement, a press drive for cycling the slide mechanism, a clutch for connecting and disconnecting a press drive and the slide mechanism, and a brake for braking the press drive shaft, the system comprising means for starting the press by hydraulically disengaging the brake and hydraulically engaging the clutch at a predetermined intermediate torque level which is less than the full clutch torque level, and then maintaining the clutch at the intermediate torque level until the press drive shaft has attained substantially full speed, after which the clutch torque is increased to the full clutch torque level; and means for stopping the press by hydraulically disengaging the clutch and engaging the brake at a predetermined intermediate torque level which is less than the full brake torque, and then maintaining the brake at the intermediate torque level until the press drive shaft has substantially stopped, after which the brake torque is increased to the full brake torque level.

In the drawings:

FIGS. 1*a* and 1*b* are response curves for a typical prior art pneumatic clutching and braking system for a power press;

FIGS. 2*a* and 2*b* are response curves for a hydraulic clutching and braking system embodying the invention and using the brake and clutch mechanisms illustrated in FIGS. 1–4.

While the invention has been shown and will be described in some detail with reference to a preferred and exemplary embodiment, there is no intention to limit the invention to this particular embodiment. On the contrary, it is intended to cover all alternatives, modifications and equivalent arrangements within the spirit and scope of the invention as defined by the appended claims.

Figures 1A, 1B:
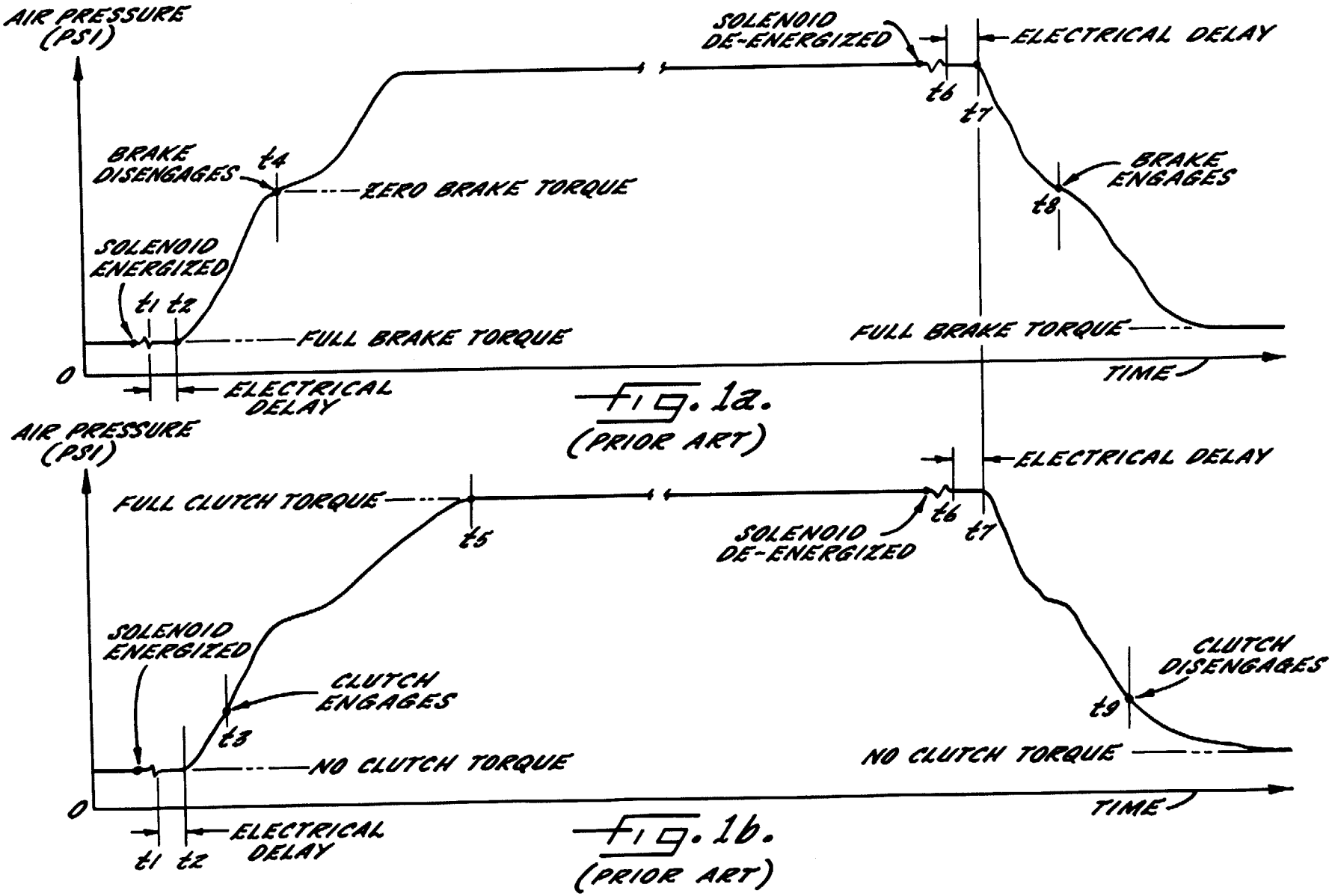
FIG. 1a. (PRIOR ART)
FIG. 1b. (PRIOR ART)

Turning now to the drawings and referring first to FIGS. 1*a* and 1*b*, these figures illustrate typical response curves for a pneumatic clutching and braking system that has been used in power presses for a number of years. As mentioned previously, the brake in such a system is usually engaged by mechanical springs and disengaged by pneumatic pressure acting against the spring pressure, whereas the clutch is engaged by pneumatic pressure and disengaged by merely exhausting the pneumatic pressure. To start the press, a solenoid is energized at time t1 to actuate a valve that initiates the application of pneumatic pressure to both the brake and the clutch at time t2, following a short "electrical delay" for operation of the solenoid valve. The pneumatic pressure then begins to build up, and at time t3 the clutch engages, albeit at a torque level well below the full clutch torque level. Following initial engagement of the clutch at time t3, the clutch torque continues to increase until it reaches its maximum level at time t5. While the clutch torque is increasing, the press drive shaft accelerates at an increasingly rapid rate, particularly when the clutch approaches its full torque level. For example, in a typical power press using such a pneumatic clutching and braking system, the press drive shaft is accelerated to full speed in less than 2 seconds, producing acceleration forces in excess of 3.3 "g"'s.

While the clutch torque is building up, the brake disengages at time t4. The brake remains disengaged until a solenoid is de-energized to stop the press, at time t6 in FIGS. 1*a* and 1*b*. This solenoid actuates a valve that exhausts the pneumatic pressure from both the clutch and the brake, but at a slower rate from the brake than from the clutch because the brake cannot be engaged until the clutch torque has been reduced to a certain level. At time t7, following another "electrical delay" for the operation of the solenoid valve, the pneumatic pressure on both the brake and the clutch begins to diminish at the different rates. The brake is finally engaged at time t8, just slightly before the pneumatic pressure on the clutch drops sufficiently to disengage the clutch at time t9. Following engagement of the brake at time t8, the brake torque increases rapidly with a correspondingly rapid deceleration of the press drive shaft.

Turning next to FIGS. 2*a* and 2*b*, these figures illustrate the response curves for a hydraulic clutching and braking system according to the present invention. Secific clutch and brake mechanisms for use in this hydraulic system will be described in detail below, but it will be helpful to first understand the operating characteristics of the system as illustrated in FIGS. 2*a* and 2*b*. To start the press with this system, a solenoid is energized at time t10 to actuate a valve that removes hydraulic pressure from the brake and applies hydraulic pressure to the clutch. Following a short "electrical delay" for operation of the valve, this system immediately disengages the brake and engages the clutch at time t11. The hydraulic system reacts almost instantaneously—much faster than a pneumatic system. Thus the brake torque immediately drops to zero at time t11, and the clutch torque immediately increases to an intermediate torque level determined by one of two sources of hydraulic pressure for the clutch. For example, the intermediate torque level is typically about 10% of full clutch torque. The clutch is maintained at this intermediate torque level for a preselected time interval, extending from time t11 to time t12 in FIG. 2*b*, which is sufficient to bring the press drive shaft up to full speed. At the end of that interval, which is at time t12 in the illustrative example, the hydraulic pressure on the clutch is increased to immediately raise the clutch torque to its full-on level, which is determined by the source of hydraulic pressure for the clutch.

Instead of using a preselected time interval to determine when the clutch torque should be raised from the intermediate level to the full-on level, a tachometer can be used to monitor the actual speed of the press drive shaft and detect when it reaches full speed. The tachometer output can be used to produce a signal which automatically connects the full-on pressure source to the clutch as soon as the drive shaft reaches full speed.

Because the clutch torque is maintained at the intermediate torque level while the press drive shaft is brought up to speed, the drive shaft is accelerated at a much more constant rate than in the pneumatic system described above. More specifically, the acceleration of the drive shaft begins more quickly, and initially at a faster rate, because of the immediate response of the hydraulic system. Later on in the startup interval (t11 to t12), the acceleration produced by the hydraulic system is slower than that produced by the pneumatic system because the hydraulic system brings the drive shaft up to speed at a relatively constant rate of acceleration, avoiding the extremely high acceleration forces produced by the pneumatic system toward the end of the startup interval. Thus, by maintaining the clutch torque at only a fraction of its full-on value until the press drive shaft has been brought up to speed, the hydraulic system provides a "soft" startup without any abrupt transitions or high acceleration rates which can upset the automation system and the workpiece handling mechanisms controlled thereby. For example, in the same press mentioned above as producing acceleration forces in excess of 3.3 "g"'s during startup, the maximum acceleration force during startup with the system of FIGS. 2*a* and 2*b* is only bout one "g".

After the clutch torque has been increased to its full-on level at time t12, it is maintained at this level until it is desired to stop the press. Stopping is initiated by de-energizing a solenoid at time t13 to actuate a valve that applies hydraulic pressure to the brake and removes hydraulic pressure from the clutch. Following another brief "electrical delay" from time t13 to time t14, this immediately disengages the clutch and engages the brake (at time t14). The brake torque is initially limited, however, to an intermediate torque level, e.g., 40% in the example of FIG. 2*a*, until the press drive shaft has been substantially stopped at time t15. Stopping the drive shaft with this intermediate level of brake torque provides a "soft" stop, i.e., the drive shaft is decelerated at a relatively slot and constant rate to avoid abrupt transitions of the type produced by the pneumatic system described above. Consequently, the hydraulic braking action does not disrupt the automation system or the workpiece handling mechanisms controlled thereby.

At time t15, after the press drive shaft has been essentially stopped, the full hydraulic pressure is applied to the brake to produce full brake torque. The brake is then maintained at this full torque level until it is desired to start the press again. As in the case of the hydraulic clutch, the two different torque levels for the hydraulic brake are determined by two sources of hydraulic pressure for the brake. The brake is connected to the first source, which sets the intermediate torque level, from time t14 to time t15, and then is switched to the second source, which sets the full-on torque level.

Even with the slower deceleration rates produced by the hydraulic system illustrated in FIGS. 2*a* and 2*b*, the press is still stopped much more quickly than it is by the pneumatic system illustrated in FIGS. 1*a* and 1*b* because there is no need to wait for pneumatic pressure to be dissipated from the system. For example, a typical press that can be stopped in 0.52 seconds by the pneumatic clutch and brake system can be stopped in only 0.37 seconds with a hydraulic clutch and brake system operated in the manner illustrated in FIGS. 2*a* and 2*b*. If it is desired to stop the press even more quickly, in an emergency situation, the hydraulic brake can be applied with immediate full brake torque at time t14, as illustrated by the broken lines in FIG. 2*a*. This "panic stop" mode of operation illustrated by the broken lines is undesirable because of the high rate of deceleration that it produces, but it will stop the press very quickly in an emergency.

Figure 3:
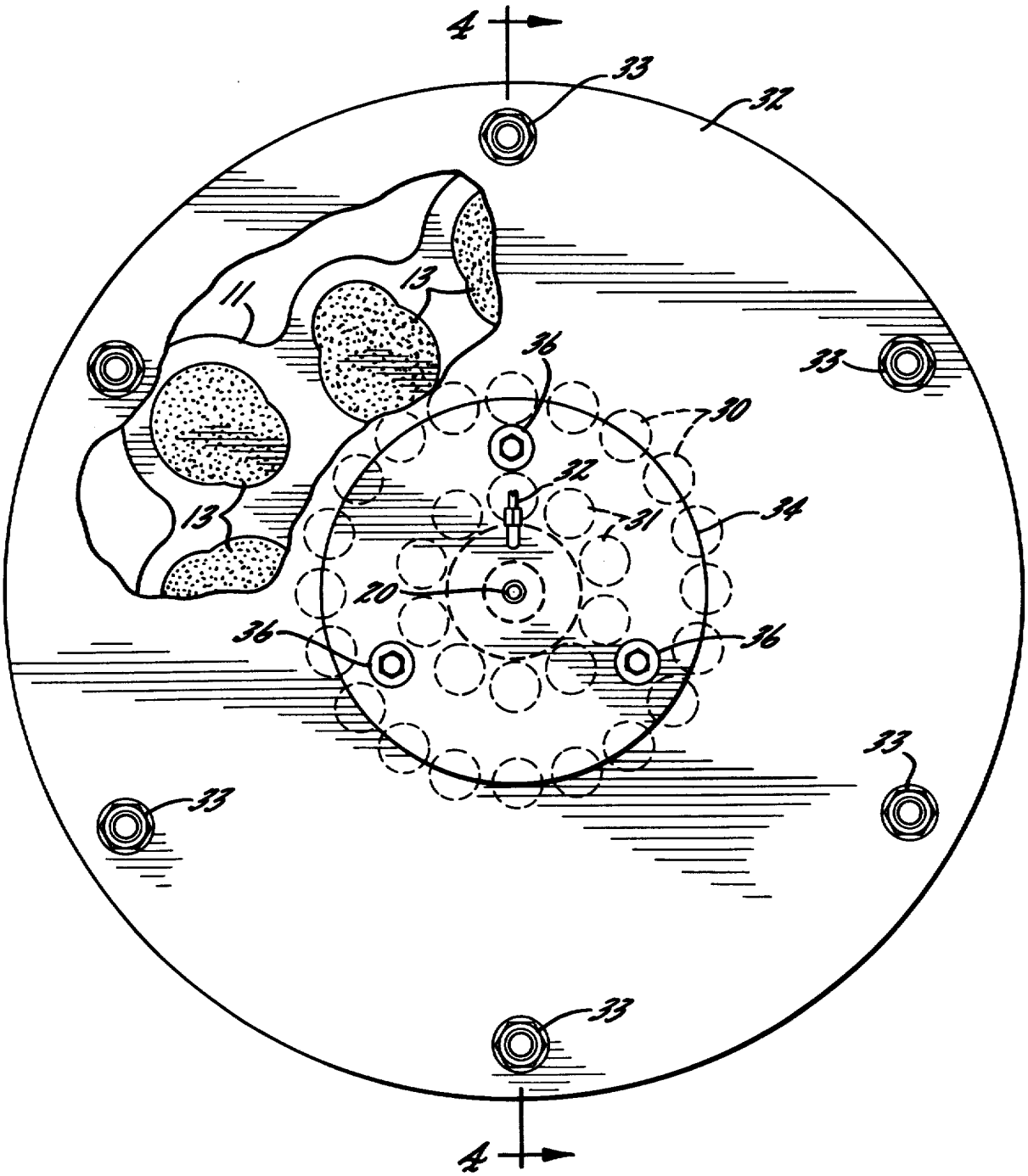
FIG. 3 is an end elevation view of a hydraulic brake for use in a press starting and stopping system embodying the invention, with a fragment thereof broken away to show the underlying structure.
Figure 4:
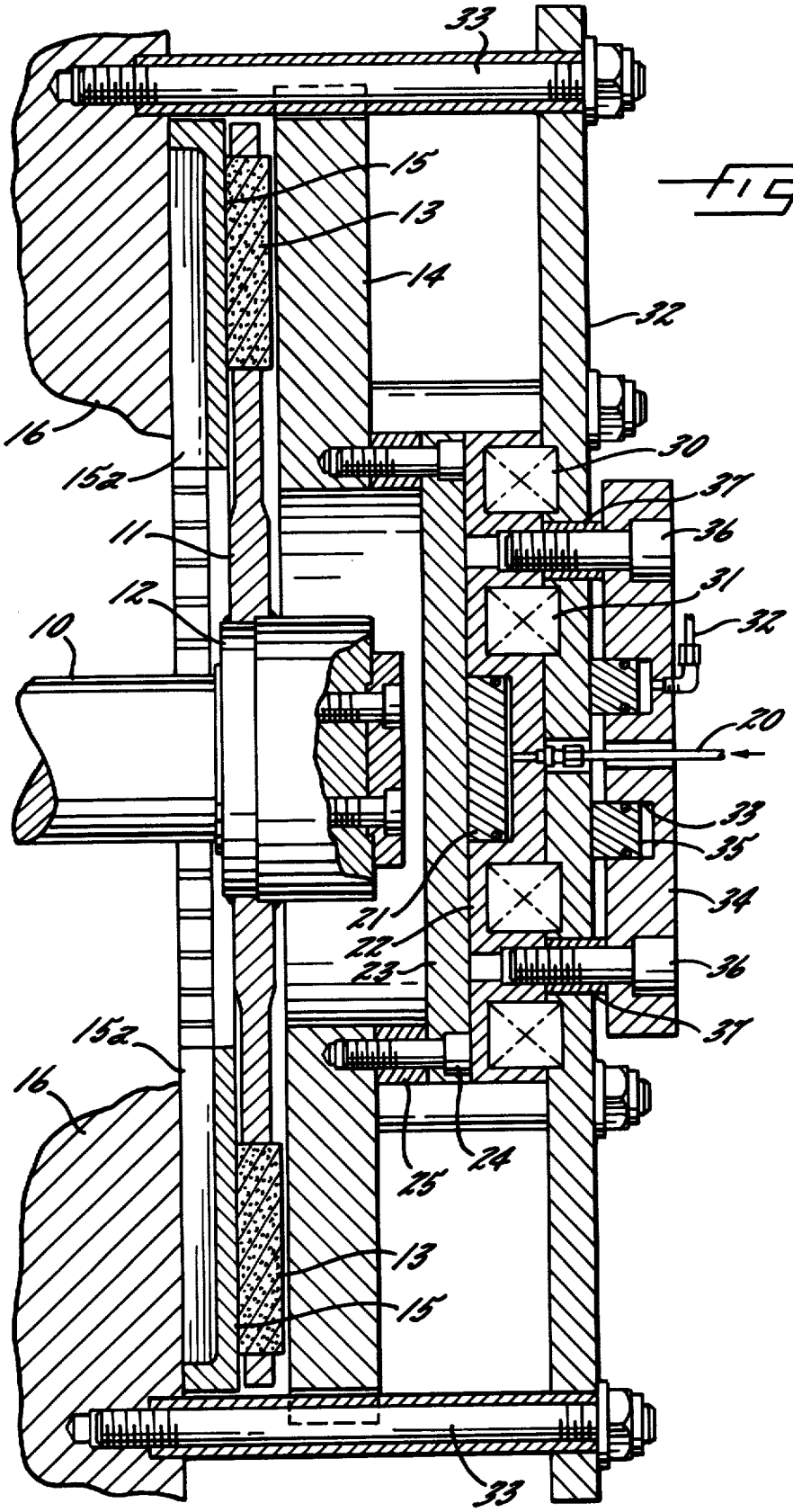
FIG. 4 is a section taken generally along line 4—4 in FIG. 3.

Exemplary clutch and brake mechanisms for use in a hydraulic system of the type described above in connection with FIGS. 2*a* and 2*b* are illustrated in FIGS. 3–6. Turning first to FIGS. 3 and 4, there is shown a hydraulically operated brake for applying a braking torque to a press drive shaft 10. A brake disc 11 is affixed to a hub 12 on the end of the shaft 10, and a plurality of brake pads 13 are carried by the disc 11 and arranged in a symmetrical array around the circumference of the disc. To apply the brake, a movable gripper ring 14 is advanced into engagement with one side of the brake pads 13 to press the pads against a stationary gripper ring 15 fastened to the press frame 16. To assist in the dissipation of heat from the brake, a multiplicity of radial ribs 15*a* are formed on the outside of the ring 15.

The movable gripper ring 14 is advanced into its engaged position by means of hydraulic pressure supplied through a line 20 to a piston 21 slidably mounted in a primary cylinder plate 22. The hydraulic pressure moves the piston 21 to the left, as viewed in FIG. 4, thereby advancing a pressure plate 23 which is rigidly connected to the movable gripper ring 14 by means of a plurality of bolts 24 and spacers 25. To release the brake, the hydraulic pressure is simply removed from the line 20.

As a fail safe feature, two circular arrays of compressed coil springs 30 and 31 are mounted in recesses formed in the surface of the primary cylinder plate 22 and mating recesses formed in the adjacent surface of a plate 32 which are rigidly fastened to the press frame by a plurality of bolts 33. The pressure of these springs 30 and 31 urges the cylinder plate 22 to the left as viewed in FIG. 4, but such movement of the cylinder plate is prevented during normal operation of the brake by an over-riding hydraulic pressure. More specifically, hydraulic pressure is applied through a line 32 to an annular cylinder 33 formed by a secondary cylinder plate 34 and containing an annular piston 35. The two cylinder plates 22 and 34 are connected by a plurality of machine screws 36 passing through corresponding spacers 37, which in turn pass through the fixed plate 32. Thus, it can be seen that the two cylinder plates 22 and 34 are linked together in a rigid assembly which can be moved back and forth relative to the fixed plate 32 which is disposed between the two cylinder plates to provide a stationary support for one end of the springs 30 and 31.

During normal operation of the brake, the two cylinder plates 22 and 34 are held in the retracted position, illustrated in FIG. 4, by the hydraulic pressure from line 32. This hydraulic pressure forces the cylinder plate 37 to the right, as viewed in FIG. 4, because the annular piston 35 is bottomed out on the fixed plate 32.

In the event of a malfunction in the hydraulic system, the hydraulic pressure from the line 32 will drop off, because the line 32 is connected to the same pressure source as the primary actuator line 20. When the hydraulic pressure drops below a certain level, the springs 30 and 31 move the two cylinder plates 22 and 34 to the left (as viewed in FIG. 4) thereby advancing the movable gripper ring 14 into engagement with the friction pads 13 to apply the brake. Consequently, the brake fails in a safe mode, automatically braking the press drive shaft in the event of a malfunction in the hydraulic system.

Figure 5:
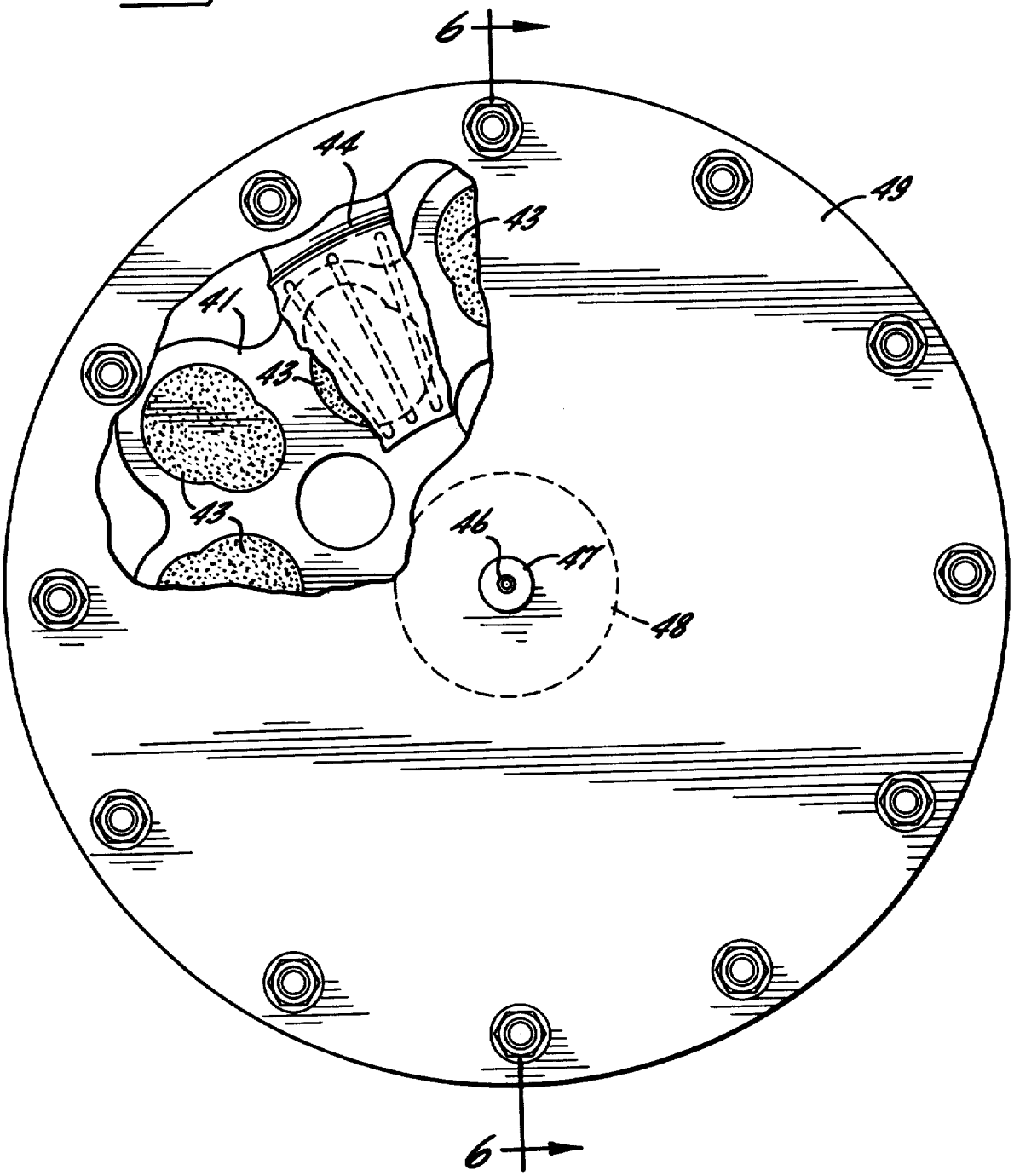
FIG. 5 is an end elevation of a hydraulic clutch for use in a press starting and stopping system embodying the invention, with fragments thereof broken away to show the underlying structure.
Figure 6:
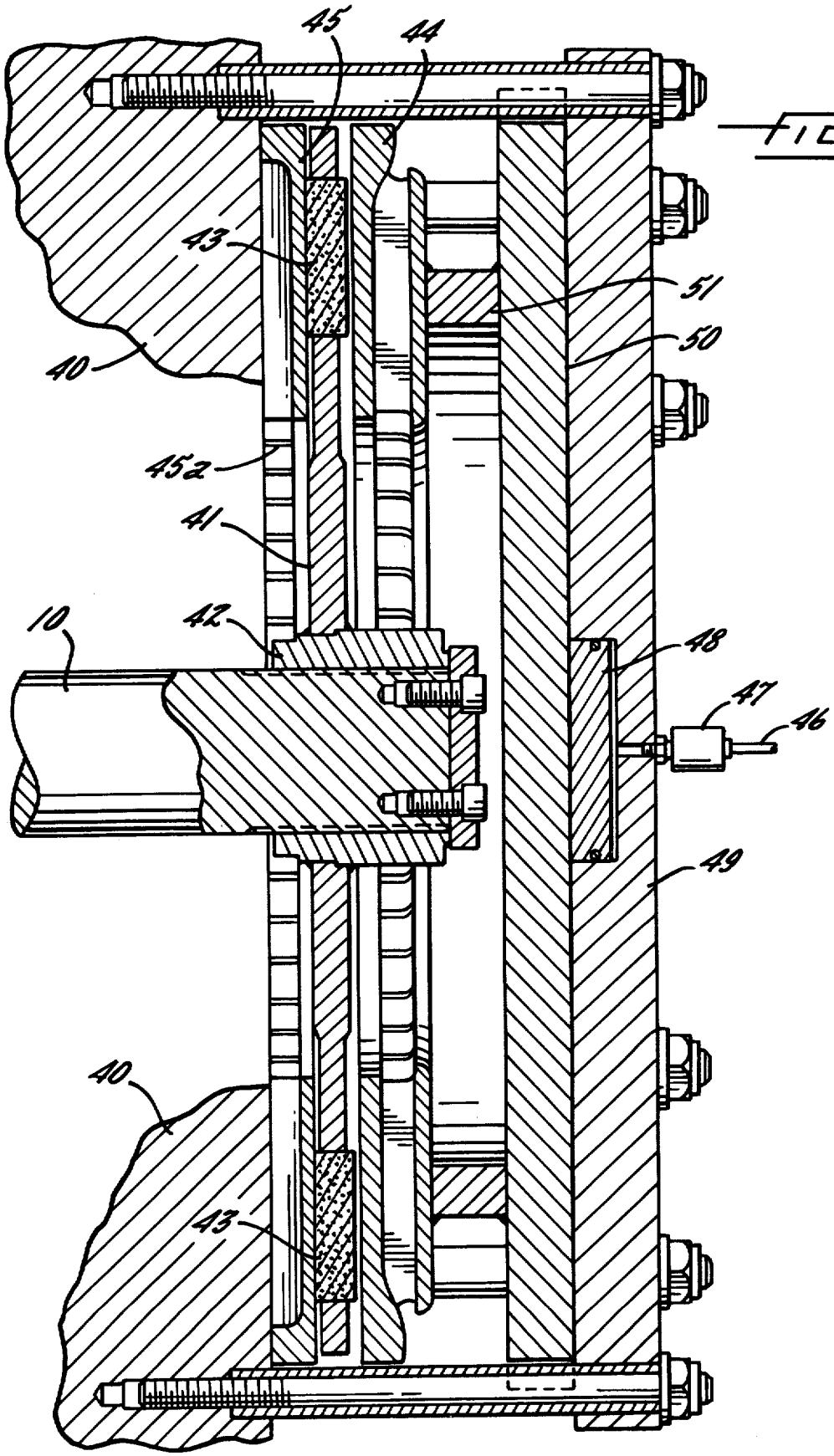
FIG. 6 is a section taken generally along line 6—6 in FIG. 5.

A hydraulically operated clutch, for use in conjunction with the hydraulic brake of FIGS. 3 and 4, is shown in FIGS. 5 and 6. The clutch is used to connect and disconnect the press drive shaft 10 and a flywheel 40 through a clutch disc 41 affixed to a hub 42 on the drive shaft. A plurality of friction pads 43 are carried by the disc 41 in a symmetrical array around the circumference of the disc. To engage the clutch, a movable gripper ring 44 is advanced into engagement with one side of the friction pads 43 to press the pads against a stationary gripper ring 45 fastened to the flywheel 40. To assist in the dissipation of heat from the clutch, a multiplicity of fins 45*a* are formed on the outside of the ring 45.

The movable gripper ring 44 is advanced into its engaged position by means of hydraulic pressure supplied through a line 46 and a rotary coupling 47 to a piston 48 slidably mounted in a cylinder plate 49. The hydraulic pressure moves the piston 48 to the left, as viewed in FIG. 6, thereby advancing a pressure plate 50 which is rigidly connected to the movable gripper ring 44 by means of a spacer ring 51. To disengage the clutch, the hydraulic pressure is simply removed from the line 46.

As can be seen from the foregoing detailed description, this invention provides an improved clutch and brake system for starting and stopping a power press quickly and yet smoothly so as to avoid abrupt movements of the type that can disrupt automation systems. This system permits rapid response to signals commanding the press to start or stop, while at the same time starting and stopping the press in a "soft" manner without excessive rates of acceleration and deceleration. The brake can be applied at the same time that the clutch is being disengaged, thereby minimizing the stopping time and motion. With this system, the productivity of an automated press system having automatically controlled workpiece handling mechanisms can be increased while also minimizing the danger of damage to, and prolonging the operating life of, those portions of the press involved in or controlled by the automation system.

I claim as my invention:

1. A method of starting and stopping a power press having a slide mechanism mounted for reciprocating movement, a press drive for cycling the slide mechanism, a clutch for connecting and disconnecting the press drive and the slide mechanism, and a brake for braking the press drive shaft, said method comprising starting the press by hydraulically disengaging the brake and hydraulically engaging the clutch at a predetermined intermediate torque level which is less than the full clutch torque level, maintaining the clutch at said intermediate torque level until the press drive shaft has attained substantially full speed, and then increasing the clutch torque to the full clutch torque level, stopping the press by hydraulically disengaging the clutch and hydraulically engaging the brake at a predetermined intermediate torque level which is less than the full brake torque level, and maintaining the brake at said intermediate torque level until the press drive shaft has substantially stopped, and then increasing the brake torque to the full brake torque level.

2. A method of starting and stopping a power press as set forth in claim 1 wherein said clutch is engaged simultaneously with the disengagement of said brake.

3. A method of starting and stopping a power press as set forth in claim 1 wherein said brake is engaged simultaneously with the disengagement of said clutch.

4. A method of starting and stopping a power press as set forth in claim 1 wherein said brake comprises a brake disc attached to the press drive shaft and carrying a plurality of friction pads, gripping means for engaging said friction pads and thereby braking said drive shaft, and hydraulic actuating means for urging said gripping means against said friction pads, and a source of hydraulic pressure for said actuating means.

5. A method of starting and stopping a power press as set forth in claim 1 wherein said brake comprises a brake disc attached to the press drive shaft and carrying a plurality of friction pads, gripping means for engaging said friction pads and thereby braking said drive shaft, hydraulic actuating means for urging said gripping means against said friction pads, and a source of hydraulic pressure for said actuating means, spring means for urging said gripping means against said friction pads, and means for removing the pressure of said spring means from said gripping means in response to normal hydraulic pressure from said source, so that said spring means urge said gripping means against said friction pads only in the event of an abnormally low hydraulic pressure from said source.

6. A method of starting and stopping a power press as set forth in claim 5 wherein said means for removing the pressure of said spring means comprises movable mechanical actuating means coupling said spring means to said gripping means, and an auxiliary hydraulic piston for immobilizing said mechanical actuating means in response to normal hydraulic pressure from said source, and for enabling said mechanical actuating means to couple said spring means to said gripping means in response to an abnormally low hydraulic pressure from said source.

7. A method of starting and stopping a power press as set forth in claim 1 wherein said brake comprises a brake disc attached to the press drive shaft and carrying a plurality of friction pads, gripping means for engaging said friction pads and thereby braking said drive shaft, hydraulic actuating means for urging said gripping means against said friction pads, and a source of hydraulic pressure for said actuating means, and means for applying a spring force to said gripping means to urge the same against said friction pads in response to a drop in said hydraulic pressure below a predetermined level, whereby said drive shaft is automatically braked in the event of a failure in the hydraulic system.

8. A method of starting and stopping a power press as set forth in claim 1 wherein said clutch comprises a clutch disc attached to the press drive shaft and carrying a plurality of friction pads, gripping means for engaging said friction pads and thereby coupling said clutch disc and drive shaft to said slide mechanism, and hydraulic actuating means for urging said gripping means against said friction pads, and a source of hydraulic pressure for said actuating means.

9. A method of starting and stopping a power press having a slide mechanism mounted for reciprocating movement, and a press drive for cycling the slide mechanism, said method comprising starting the press by hydraulically actuating a clutch mechanism to drivingly engage the press drive with the slide mechanism, applying a driving torque to the slide mechanism at a predetermined low level for a selected time interval following the initial actuation of said clutch mechanism, and then increasing the driving torque to a predetermined high level, and stopping the press by de-actuating said clutch mechanism to disengage the press drive from the slide mechanism and hydraulically actuating a brake mechanism to apply an immediate braking force to the slide mechanism.

10. A method of starting and stopping a power press as set forth in claim 9 wherein said braking force is applied at a predetermined low level for a selected time interval following the initial actuation of said brake mechanism, and then increased to a predetermined high level.

11. A method of starting and stopping a power press as set forth in claim 9 wherein said brake is de-actuated simultaneously with the actuation of said clutch.

12. A method of starting and stopping a power press as set forth in claim 9 wherein said brake is actuated simultaneously with the de-actuation of said clutch.

13. Apparatus for starting and stopping a power press having a slide mechanism mounted for reciprocating movement, a press drive for cycling the slide mechanism, a clutch for connecting and disconnecting the press drive and the slide mechanism, and a brake for braking the press drive shaft, said apparatus comprising mean for starting the press by hydraulically disengaging the brake and hydraulically engaging the clutch at a predetermined intermediate torque level which is less than the full clutch torque level, means for maintaining the clutch at said intermediate torque level until the press drive shaft has attained substantially full speed, and then increasing the clutch torque to the full clutch torque level, means for stopping the press by hydraulically disengaging the clutch and hydraulically engaging the brake at a predetermined intermediate torque level which is less than the full brake torque level, and means for maintaining the brake at said intermeidate torque level until the press drive shaft has substantially stopped, and then increasing the brake torque to the full brake torque level.

14. Apparatus as set forth in claim 13 which includes means for engaging said clutch simultaneously with the disengagement of said brake.

15. Apparatus as set forth in claim 13 which includes means for engaging said brake simultaneously with the disengagement of said clutch.

16. Apparatus as set forth in claim 13 wherein said brake comprises a brake disc attached to the press drive shaft and carrying a plurality of friction pads, gripping means for engaging said friction pads and thereby braking said drive shaft, and hydraulic actuating means for urging said gripping means against said friction pads, and a source of hydraulic pressure for said actuating means.

17. Apparatus as set forth in claim 13 wherein said brake comprises a brake disc attached to the press drive shaft and carrying a plurality of friction pads, gripping means for engaging said friction pads and thereby braking said drive shaft, hydraulic actuating means for urging said gripping means against said friction pads, and a source of hydraulic pressure for said actuating means, spring means for urging said gripping means against said friction pads, and means for removing the pressure of said spring means from said gripping means in response to normal hydraulic pressure from said source, so that said spring means urge said gripping means against said friction pads only in the event of an abnormally low hydraulic pressure from said source.

18. Apparatus as set forth in claim 17 wherein said means for removing the pressure of said spring means comprises movable mechanical actuating means coupling said spring means to said gripping means, and an auxiliary hydraulic piston for immobilizing said mechanical actuating means in response to normal hydraulic pressure from said source, and for enabling said mechanical actuating means to couple said spring means to said gripping means in response to an abnormally low hydraulic pressure from said source.

19. Apparatus as set forth in claim 13 wherein said brake comprises a brake disc attached to the press drive shaft and carrying a plurality of friction pads, gripping means for engaging said friction pads and thereby braking said drive shaft, hydraulic actuating means for urging said gripping means against said friction pads, and a source of hydraulic pressure for said actuating means, and means for applying a spring force to said gripping means to urge the same against said friction pads in response to a drop in said hydraulic pressure below a predetermined level, whereby said drive shaft is automatically braked in the event of a failure in the hydraulic system.

20. Apparatus as set forth in claim 13 wherein said clutch comprises a clutch disc attached to the press drive shaft and carrying a plurality of friction pads, gripping means for engaging said friction pads and thereby coupling said clutch disc and drive shaft to said slide mechanism, and hydraulic actuating means for urging said gripping means against said friction pads, and a source of hydraulic pressure for said actuating means.

21. Apparatus for starting and stopping a power press having a slide mechanism mounted for reciprocating movement, and a press drive for cycling the slide mechanism, said apparatus comprising means for starting the press by hydraulically actuating a clutch mechanism to drivingly engage the press drive with the slide mechanism, means for applying a drive torque to the slide mechanism at a predetermined low level for a selected time interval following the initial actuation of said clutch mechanism, and then increasing the driving torque to a predetermined high level, and means for stopping the press by de-actuating said clutch mechanism to disengage the press drive from the slide mechanism and hydraulically actuating a brake mechanism to apply an immediate braking force to the slide mechanism.

22. Apparatus as set forth in claim 21 which includes means for applying said braking force at a predetermined low level for a selected time interval following the initial actuation of said brake mechanism, and then increasing said braking force to a predetermined high level.

* * * * *